US007931520B2

(12) United States Patent
Bryce

(10) Patent No.: US 7,931,520 B2
(45) Date of Patent: Apr. 26, 2011

(54) TOY DISK WHEELS AND ACCESSORIES THEREFORE

(75) Inventor: Dan Bryce, Lake Geneva, WI (US)

(73) Assignee: Funderbolt Studios Inc., Springville, NY (US)

( * ) Notice: Subject to any disclaimer, the term of this patent is extended or adjusted under 35 U.S.C. 154(b) by 282 days.

(21) Appl. No.: 12/364,592

(22) Filed: Feb. 3, 2009

(65) Prior Publication Data

US 2010/0197196 A1 Aug. 5, 2010

(51) Int. Cl.
*A63H 18/00* (2006.01)

(52) U.S. Cl. ..... 446/444; 446/458; 446/273; 446/431; 473/594

(58) Field of Classification Search ..... 446/458, 446/448, 437, 69, 369, 431, 326, 93–96, 446/237, 238, 470, 168, 233, 234, 235, 236, 446/269–294, 444; 40/409, 411, 415, 421, 40/587; 473/594

See application file for complete search history.

(56) References Cited

U.S. PATENT DOCUMENTS

| | | | | | |
|---|---|---|---|---|---|
| 183,549 | A | * | 10/1876 | Dunham | 446/458 |
| 955,435 | A | * | 4/1910 | Reed | 446/273 |
| 2,351,762 | A | * | 6/1944 | Hoover | 446/269 |
| 2,473,574 | A | * | 6/1949 | Davis | 446/243 |
| D157,464 | S | * | 2/1950 | Biggs | D21/455 |
| 2,575,743 | A | * | 11/1951 | Biggs | 446/273 |
| 2,786,300 | A | * | 3/1957 | Fong | 446/444 |
| 3,475,855 | A | * | 11/1969 | Edwards | 446/431 |
| 4,213,266 | A | * | 7/1980 | Hyland et al. | 446/431 |
| D282,950 | S | * | 3/1986 | Adams | D21/455 |
| 4,610,637 | A | * | 9/1986 | Ferguson | 446/237 |
| 4,929,216 | A | * | 5/1990 | Morris et al. | 446/324 |
| 7,166,047 | B2 | * | 1/2007 | May et al. | 473/569 |

* cited by examiner

*Primary Examiner* — Gene Kim
*Assistant Examiner* — Matthew B Stanczak
(74) *Attorney, Agent, or Firm* — Adam K. Sacharoff; Much Shelist

(57) ABSTRACT

In one embodiment of the present invention there is provided a toy disk wheel. The disk wheel is defined to include a housing having first and second housing members, each housing member is substantially shaped as a half disk such that assembly of the first and second housing members forms a disk with a rounded outer surface to permit the housing to roll on a surface and a pair of outer sections. A transparent side portion is positioned along each outer surface of the pair of outer sections. Each transparent side portion includes a protuberance positioned about the center of the transparent side portion with a notch positioned thereon. The notch is used to accommodate an axle having ends which transverse the housing to rotatably position in the notches of both side portions.

7 Claims, 7 Drawing Sheets

10
65
44
40
35
50
92
82
80
88
86
75
76
70
72
74
25

10
15
100
101
105
110
115
55

315
300
10
16
305
310
38

TOY DISK WHEELS AND ACCESSORIES THEREFORE

FIELD OF THE INVENTION

The present invention relates to toys and more particularly to gravity propelled roller disks of the type further detailed herein.

BACKGROUND ART

While the field of toys is well known and well developed there is always a continual need for improvements that increase the time kids play with the toys, especially toddlers and infants. The growth potential for these children may very well be dependant upon interaction between the child and its environment, including parents, siblings, activities, developmental toys, and other playful toys.

SUMMARY OF THE INVENTION

In one embodiment of the present invention there is provided a toy disk wheel. The disk wheel is defined to include a housing having first and second housing members, each housing member is substantially shaped as a half disk such that assembly of the first and second housing members forms a disk with a rounded outer surface to permit the housing to roll on a surface and a pair of outer sections. A transparent side portion is positioned along each outer surface of the pair of outer sections. Each transparent side portion includes a protuberance positioned about the center of the transparent side portion with a notch positioned thereon. The notch is used to accommodate an axle having ends which transverse the housing to rotatably position in the notches of both side portions.

An object having a bottom portion heavier then a top portion and having an opening therethrough is set to receive the axle such that the object is freely pivotal about the axle, whereas when the housing is rolling on a surface, gravity cause the object to rock back and forth on the axle.

In another aspect of the invention, the object being further defined as having a two piece middle section having edges positioned on either end, and a pair of outer sections separately positioned on either side of the two piece middle section, each outer section of the pair includes an armature extending to the axle and includes a ledge facing towards and resting on the edges of the two piece middle section. Further defined therein each housing member may include a flange extending towards each other housing member in a complimentary fashion such that when assembled the flanges overlap. Furthermore, the two piece middle section may further include a curved lower section terminating into an upper section, the upper section being smaller than the lower section such that the termination thereof creates the edges on either end. Yet still, the pair of outer sections may further include a lower section having an inwardly facing ledge curved to accommodate the curved lower section of the two piece middle section.

In another embodiment of the present invention the toy disk wheel may be used in combination with different accessories. In one embodiment, an accessory may be defined as having a curved tack comprising a curved bottom element having outside edges and ends, a pair of curved side walls connected to the outside edges of the curved bottom, the side walls extending between the ends of the curved bottom element, and end stops secured at each of the ends of the curved bottom element. Therefore, when the curved bottom element is rocking along its curved bottom element and a disk wheel is placed between the curved side walls the disk wheel is able to roll between the end stops with the object rocking about the axle.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 2:
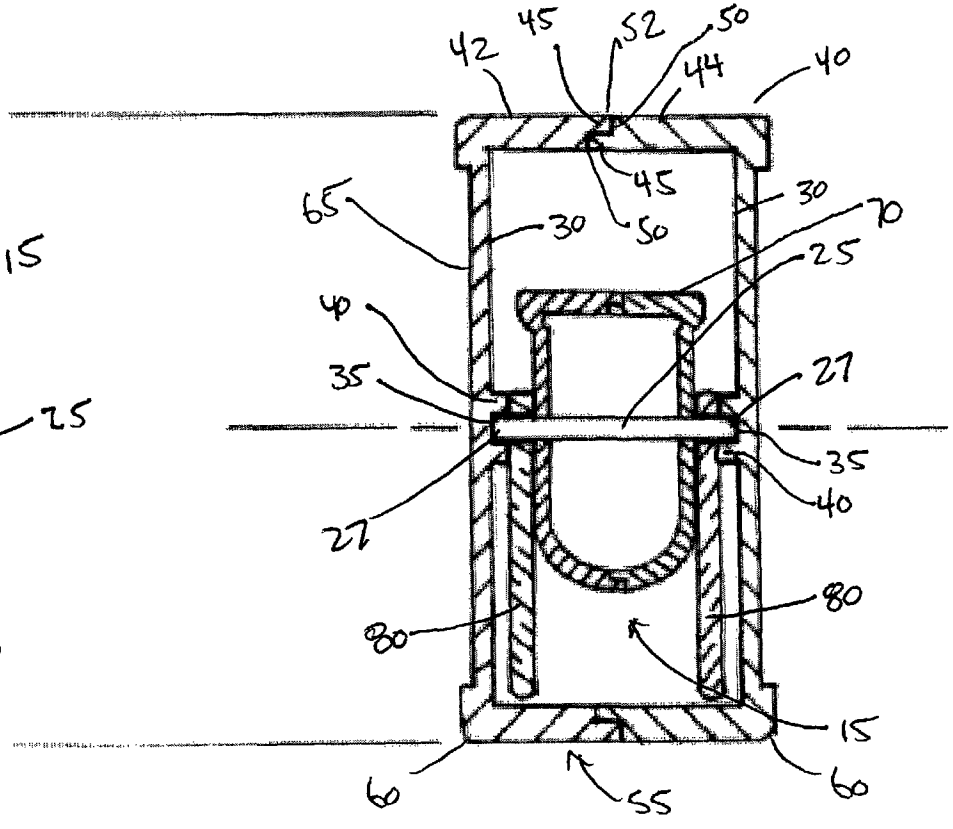
FIG. 2 is a cross section view of the disk wheel from FIG. 1 taken about line 2-2 on FIG. 1.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Figure 1:
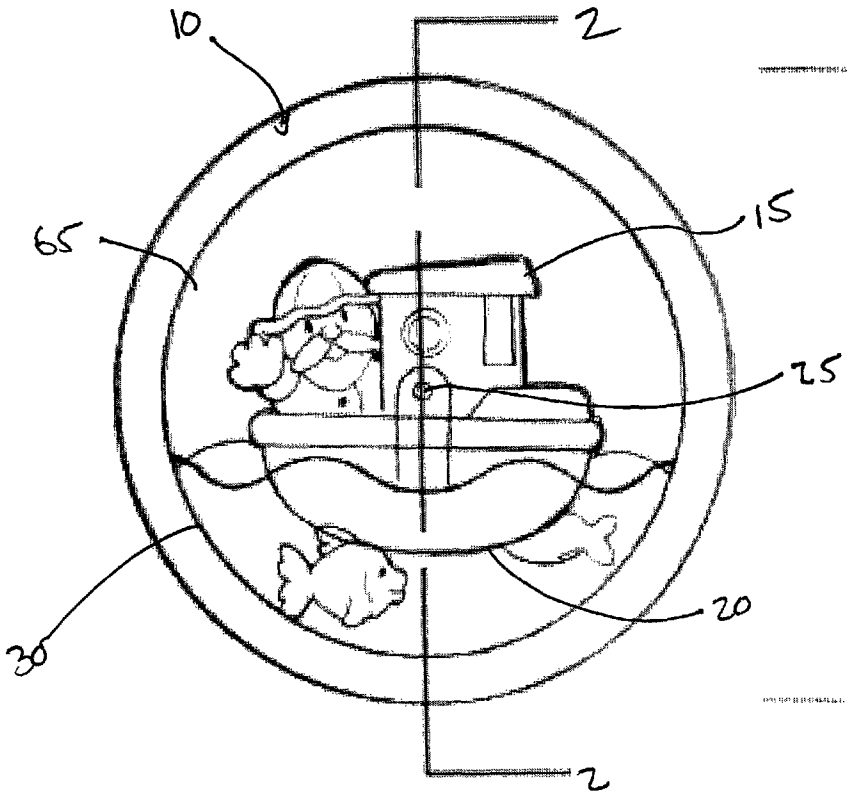
FIG. 1 is a side view of a disk wheel made in accordance with the present invention.
Figures 3A, 3B:
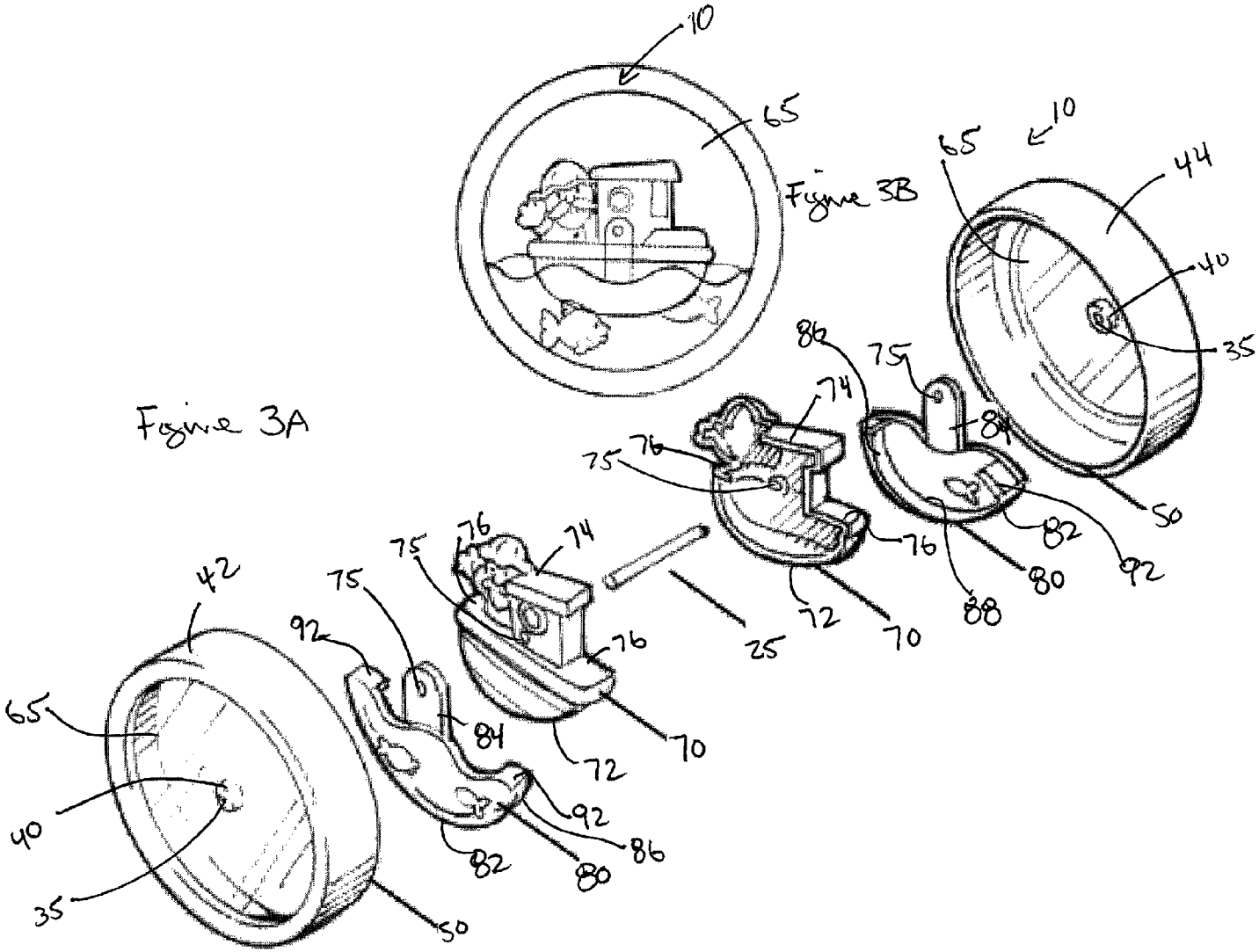
FIG. 3A is an exploded view of the disk wheel from FIG. 1.
FIG. 3B is a side view of FIG. 1.

Referring now to FIGS. 1-3, there is shown a single embodiment of a disk wheel made in accordance with the present invention and is generally referenced as numeral 10. Rather than being a sphere or circular shaped, the disk wheel is shaped as a disk to keep the wheel 10 rotating about a single plane. As shown from the side view, the disk wheel includes a suspended object 15 that is weighted or heavier on a bottom portion 20 thereof. The object 15 is suspended by freely securing the object about an axle 25. The axle 25 is rotatably secured on its ends 27 to the inner wall portions 30 of either side of the disk wheel 10.

As shown in FIG. 2, the axle 25 is positioned within a groove or notch 35 that is defined within a flange 40 that is extending inwardly from either side of the inner wall portions 30. The axle 25 traverses the width of the disk wheel 10 and is positioned through the object 15.

The disk wheel 10 is made up of a two piece housing 40. Each housing member 42 and 44 includes a complimentary flange 45 extending from an inner ridge 50 that is facing the other housing member. Thus, when assembled the two piece housing 40 as an overlapping flange section 52 that is typically sealed together with an adhesive, epoxy or glue. Also, when assembled the two piece housing 40 defines a rounded surface 55 between the outer edges 60 that is capable of supporting the disk wheel 10 in an upright fashion on a surface such that the disk wheel 10 will roll over a surface. Each housing member 42 and 44 further includes a transparent side 65 the permits the user to view the object from either side of the disk wheel 10.

The object 15 is assembled from multiple component objects. Shown in FIG. 3, the object 15 includes a two piece middle section 70 and two outer sections 80 separately positioned on either side of the two piece middle section 70. Each of the two piece middle section and the two outer sections include an opening 75 to permit the axle 25 to slide therethrough and allow the object to freely hinge or rotate from the axle 25. The two piece middle section 70 when assembled includes a lower curved section 72 that terminates into an upper section 74. The upper section 74 is slightly smaller than the lower section 72 such that the termination of the two sections 72 and 74 is provided with edges 76 on either side of the upper section 74. The two outer sections 80 each include a secondary lower section 82 that is curved to accommodate the curvature of the housing member and dimensioned larger than the lower curved section 72 of the two piece middle section 70. Extending upwardly from the secondary lower section 82 is an armature 84 that includes the opening 75. The secondary lower section 82 includes an inwardly facing ledge 86 extending from the edge 88 of the curved lower section 90 and from a top section 92 positioned on either side of the armature 84. This permits the assembled two piece middle section 70 to rest within and against the inwardly facing ledge 86 such that the ledge portion extending from the top section can be positioned against the edges 76 on either side of the upper section 74 of the two piece middle section.

Since the lower portion of the object 15 is heavier than the top portion, gravity causes the object 15 to rock back and forth on the axle as the disk wheel 10 rotates completely around. In the examples of the present invention, the object 15 depicted is a boat (the two piece middle section 70) with water waves (two outer sections 80).

Figures 4A, 4B, 4C:
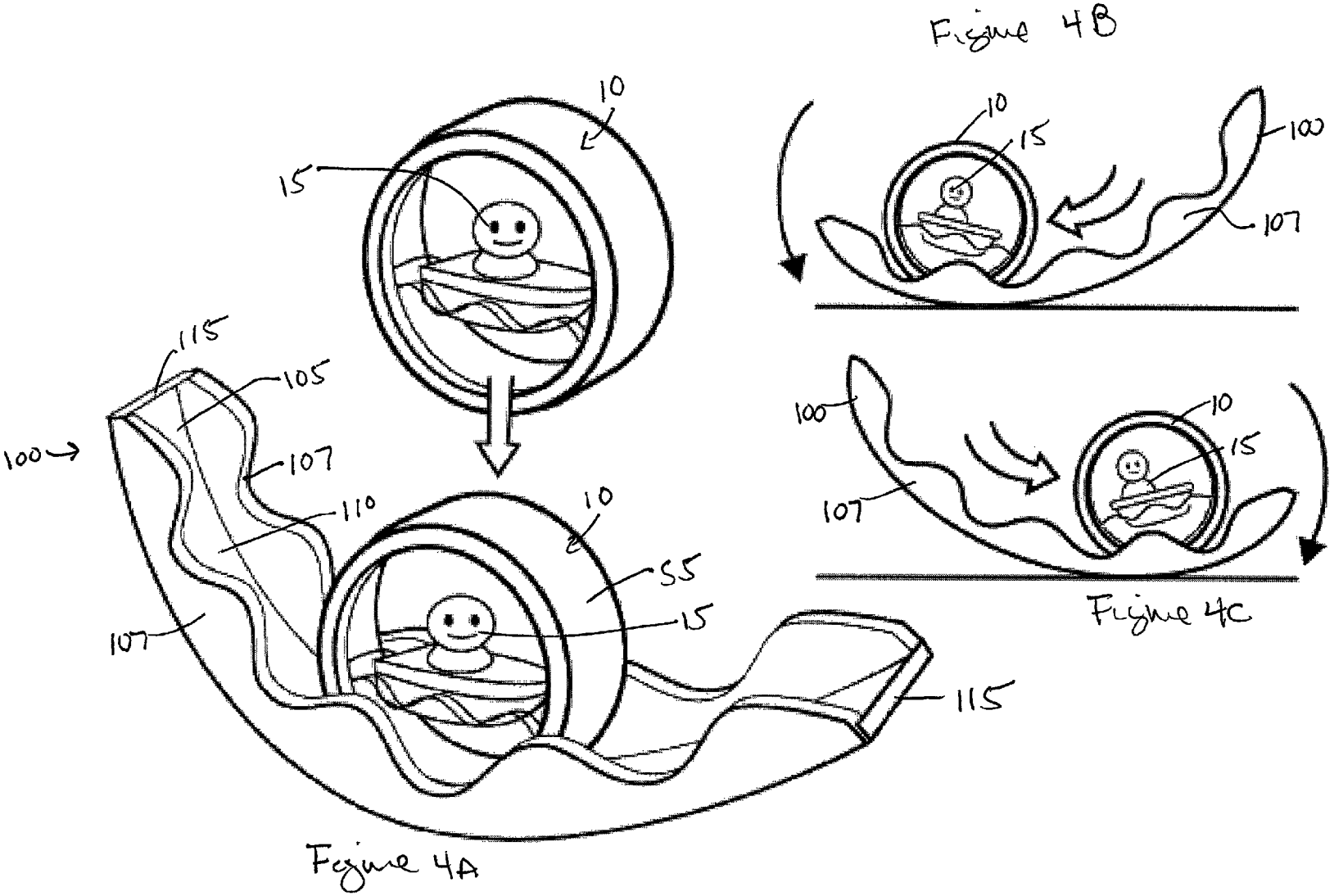
FIG. 4A is a perspective view of the disk wheel in combination with a rocking accessory.
FIG. 4B is a side view of FIG. 4A showing the disk wheel and rocking accessory in one position.
FIG. 4C is a side view of FIG. 4A showing the disk wheel and rocking accessory in another position.
Figure 5:
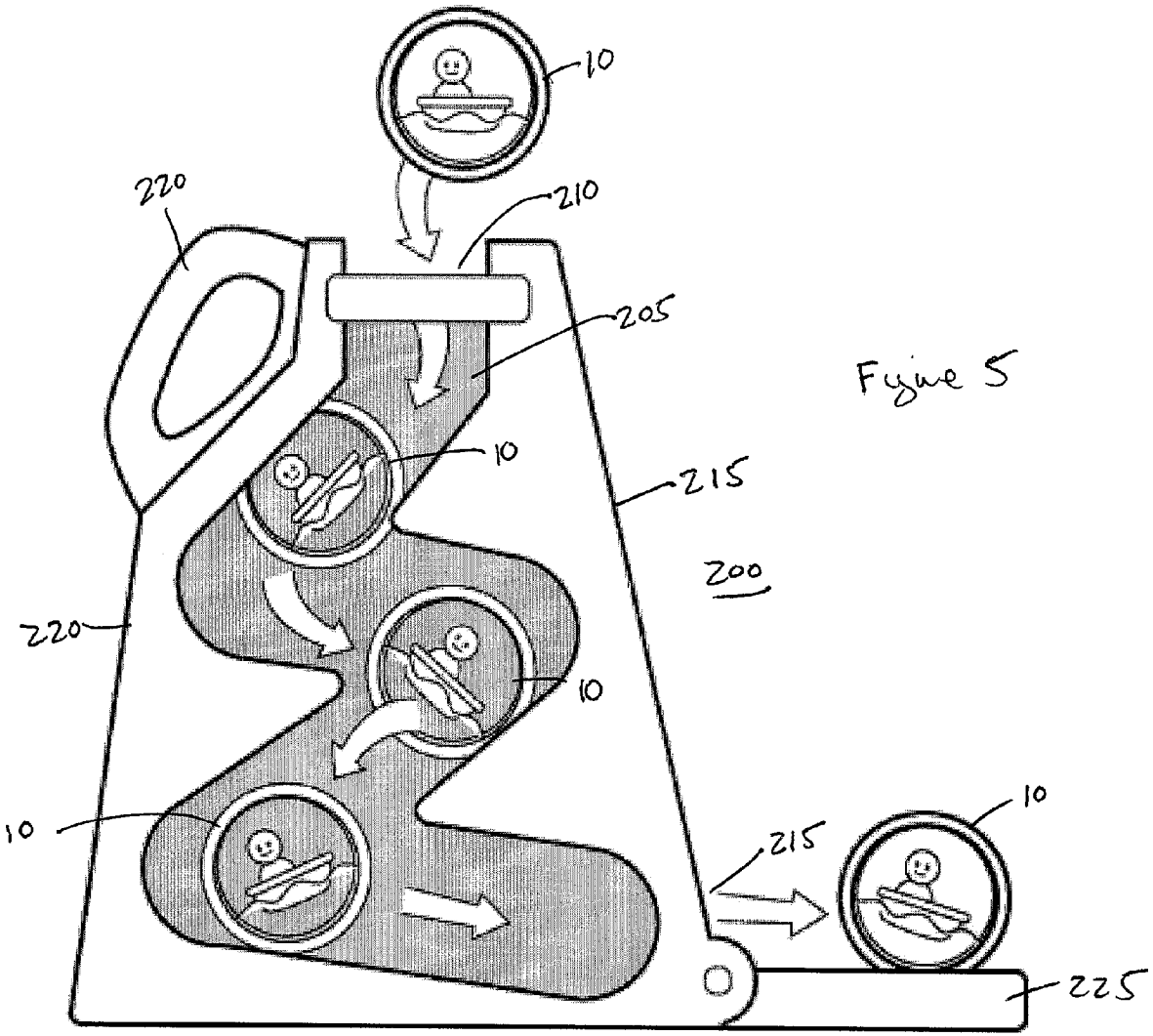
FIG. 5 is a side view of a disk wheel in combination with a tower accessory.

In another aspect of the present invention, the disk wheels 10 may be used in connection with other accessories. Referring now to FIGS. 4A through 4C, there is shown a first accessory item 100 used in combination with the disk wheel 10. The first accessory item 100 includes a curved bottom element 105 and a pair of curved side walls 107 that are connected to the outside edges of the bottom element 105. The bottom element 105 includes a top surface 110 that accommodates the outside rounded surface 55 of the disk wheel 10. End stops 115 are placed on the ends of the bottom element and side walls, to prevent the disk wheel 10 from falling out from either end of the first accessory When the first accessory item 100 is placed on a flat surface, the first accessory can rock back and forth Referring now to FIG. 5, there is shown a second accessory item 200 used in combination with the disk wheel 10. The second accessory 200 includes an enclosed area 205 that is opened from an entrance opening 210 to an exit opening 215. The disk wheel 10 is dropped through the entrance opening 210 that is position on the top portion of the accessory 200. The disk wheel 10 travels downwardly and through the enclosed area 205 to the exit opening 215 that is positioned beneath the entrance opening 210 and near the bottom portion of the accessory. The enclosed area 205 is sized to accommodate the disk wheel 10 and includes a combination of drops and turns such that the disk wheel 10 moves back and forth from the front 215 to the back 220 of the item accessory 200. In addition, one side of the accessory item 200 may be transparent such that the child can watch the disk wheel 10 turn and fall through the enclosed area 205. The item accessory 200 may include an handle 220 near the top and may include a pivotal door or exit ramp 225 that the disk wheel 10 travels on when it exits the exit opening 215.

Figures 6A, 6B, 6C:
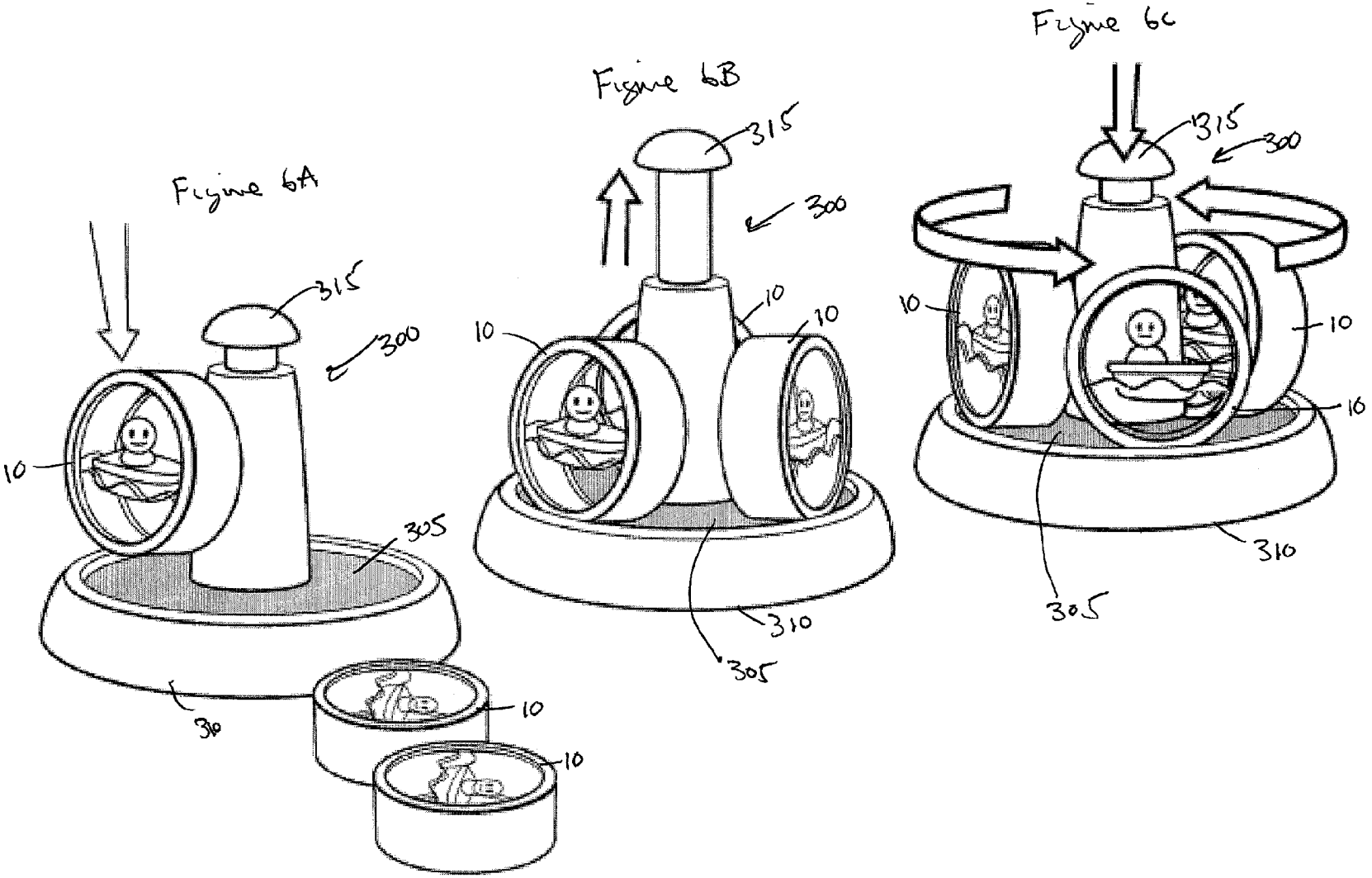
FIG. 6A is a front perspective view of a disk wheel in combination with a carousel accessory.
FIG. 6B is a front perspective view of FIG. 6A with three disk wheels and the plunger in the up position.
FIG. 6C is a front perspective view of FIG. 6A with three disk wheels and the plunger in the down position.

Referring now to FIGS. 6A through 6C, there is shown a third accessory item 300 that is in the form of a carousel. The third accessory item 300 includes a circular platform 305 that is rotates on top of a base 310. The base 310 includes a substantially flat bottom to rest on a surface. Stemming from the center of the circular platform 305 is a plunger type handle 315. When the plunger type handle is pressed downwardly, it causes the circular platform 305 to rotate. Typically when pressed repeatedly the circular platform may rotate quickly and at faster speeds. The disk wheels 10 are placed upright on the circular platform 305 and will move as the circular platform rotates. However, when the circular platform 305 stops, the momentum of the moving disk wheels will keep them moving around the circular platform.

Figure 7A:
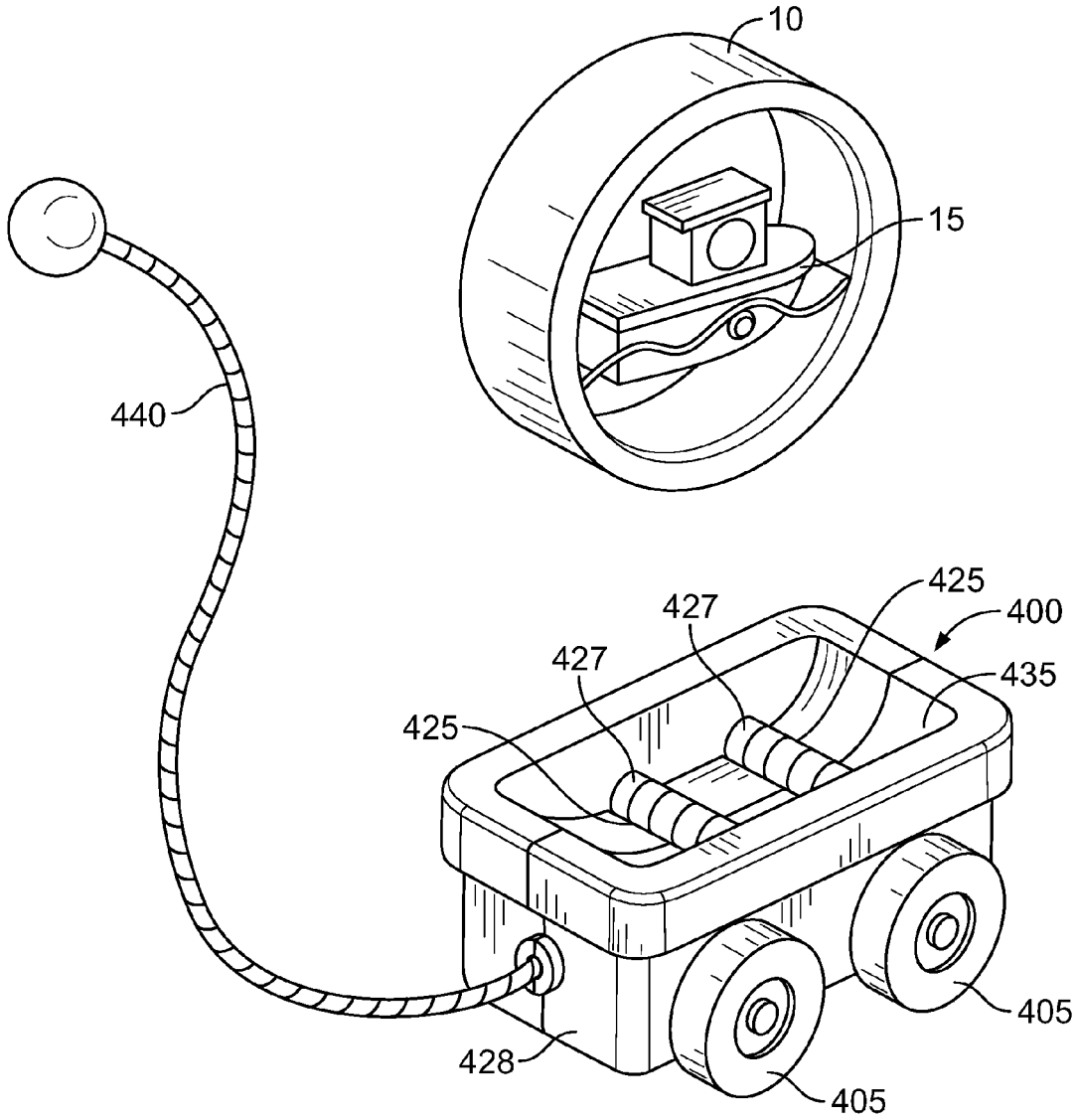
FIG. 7A is a front perspective view of a disk wheel in combination of a pull cart accessory.
Figure 7B:
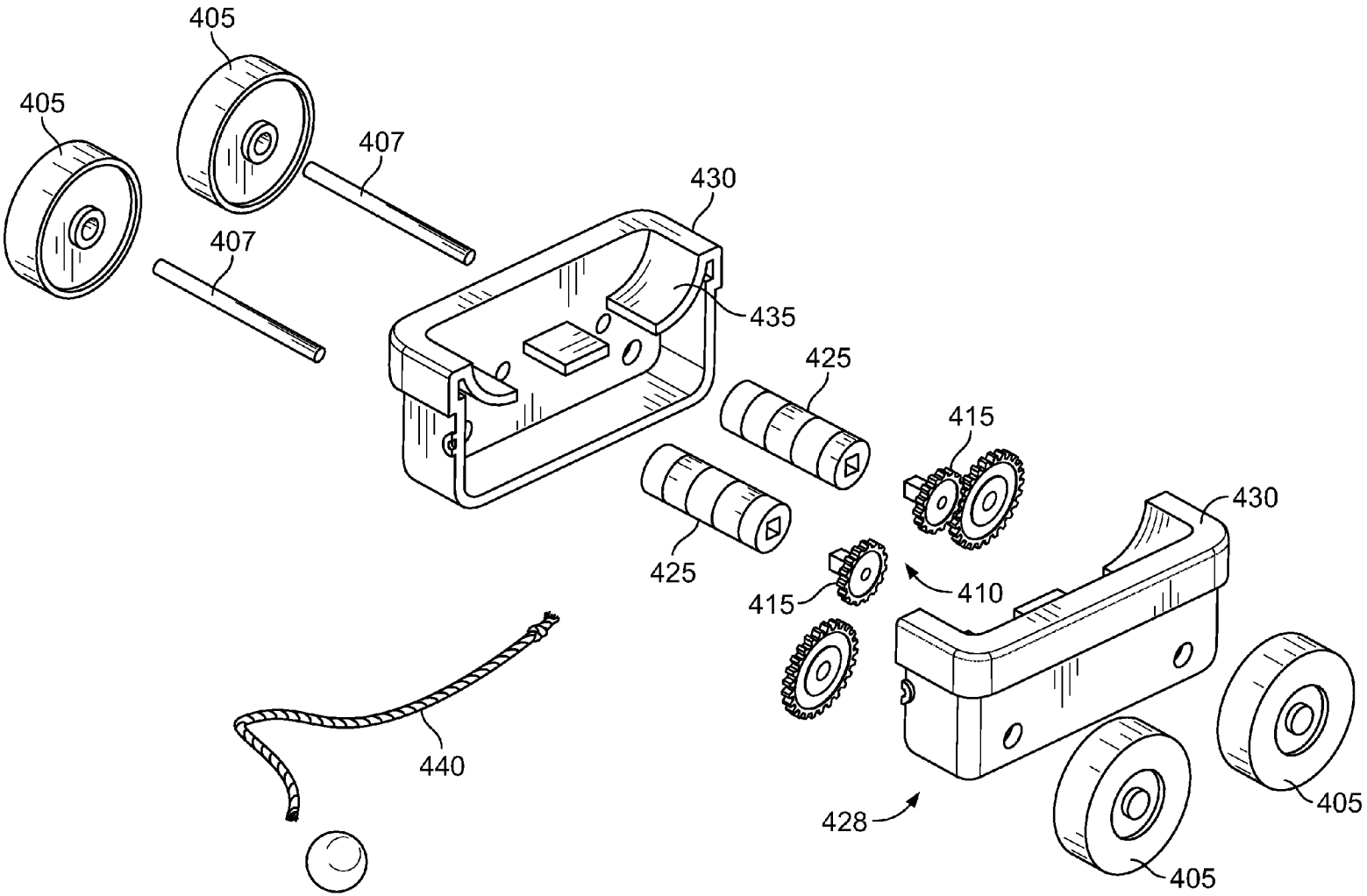
FIG. 7B is an exploded view of the pull cart accessory.

Referring now to FIGS. 7A and 7B, there is shown a fourth accessory item 400 that is in the form of a pull cart. The fourth accessory item 400 is a pull cart that includes a plurality of wheels 405 that roll on a surface. The wheels 405 are mounted on axles 407 which are in connection with a gear train system 410 that mesh with drive gears 415. The drive gears 415 are secured to a pair of rollers 425. Thus, when the pull cart rolls on the ground the movement of the wheels 405 causes the pair of rollers 425 to rotate in the same direction. The pair of rollers 425 are positioned between two halves 430 of the pull cart housing 428 and have a portion 427 that extends through an intermediate surface 435 defined by the housing 428. The rollers 425 are rotatably secured between one side of the housing 428 and the drive gears 415. A pull rope 440 is secured at one end to the cart housing 428. When the disk wheels 10 are placed upright on the rollers 425 and the pull cart 400 is pulled across a surface, the rollers 425 rotate causing the disk wheel to spin. While spinning, gravity causes the object 15 to rock back and forth on the axle as the disk wheel 10 rotates completely around.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. A toy disk wheel comprising:

a housing having first and second housing members, each housing member is substantially shaped as a half disk such that assembly of the first and second housing members forms a disk with a rounded outer surface to permit the housing to roll on a surface and a pair of outer sections;

a transparent side portion positioned along each outer surface of the pair of outer sections, each transparent side portion includes a protuberance positioned about the center of the transparent side portion with a notch positioned thereon;

an axle having ends which transverse the housing to rotatably position in the notches of both side portions; and an object having a bottom portion heavier then a top portion and having an opening therethrough to receive the axle such that the object is freely pivotal about the axle, whereas when the housing is rolling on a surface, gravity cause the object to rock back and forth on the axle, the object being further defined as having a two piece middle section having edges positioned on either end, and a pair of outer sections separately positioned on either side of the two piece middle section, each outer section of the pair includes an armature extending to the axle and includes a ledge facing towards and resting on the edges of the two piece middle section.

2. The toy disk wheel of claim 1, wherein each housing member includes a flange extending towards each other housing member in a complimentary fashion such that when assembled the flanges overlap.

3. The toy disk wheel of claim 1, wherein the two piece middle section further includes a curved lower section terminating into an upper section, the upper section being smaller than the lower section such that the termination thereof creates the edges on either end.

4. The toy disk wheel of claim 3, wherein the pair of outer sections further include a lower section having an inwardly facing ledge curved to accommodate the curved lower section of the two piece middle section.

5. In combination therewith:

a toy disk wheel comprising:

a housing shaped as a disk with a rounded outer surface to permit the housing to roll on a surface, transparent side portions positioned along opposing sides defined by the housing, each transparent side portion includes a notch positioned thereon to accommodate an axle having ends which transverse the housing to rotatably position in the notches, and an object having a bottom portion heavier then a top portion and having an opening therethrough to receive the axle such that the object is freely pivotal about the axle, whereas when the housing is rolling on a surface, gravity cause the object to rock back and forth on the axle, the object being further defined as having a two piece middle section having edges positioned on either end, and a pair of outer sections separately positioned on either side of the two piece middle section, each outer section of the pair includes an armature extending to the axle and includes a ledge facing towards and resting on the edges of the two piece middle section; and a curved tack comprising:

a curved bottom element having outside edges and ends, a pair of curved side walls connected to the outside edges of the curved bottom, the side walls extending between the ends of the curved bottom element, and end stops secured at each of the ends of the curved bottom element;

whereby when the curved bottom element is rocking along its curved bottom element and a disk wheel is placed between the curved side walls the disk wheel is able to roll between the end stops with the object rocking about the axle.

6. The toy disk wheel of claim 5, wherein the two piece middle section further includes a curved lower section terminating into an upper section, the upper section being smaller than the lower section such that the termination thereof creates the edges on either end.

7. The toy disk wheel of claim 5, wherein the pair of outer sections further include a lower section having an inwardly facing ledge curved to accommodate the curved lower section of the two piece middle section.

* * * * *